United States Patent [19]

Chia et al.

[11] 3,958,987

[45] May 25, 1976

[54] ALUMINUM IRON COBALT SILICON ALLOY AND METHOD OF PREPARATION THEREOF

[75] Inventors: E. Henry Chia; Frank M. Powers; Kenneth E. Chadwick, all of Carrollton, Ga.

[73] Assignee: Southwire Company, Carrollton, Ga.

[22] Filed: Mar. 17, 1975

[21] Appl. No.: 559,112

[52] U.S. Cl. ..... 75/148; 29/193; 29/527.7; 148/2; 148/11.5 A; 148/32; 164/76

[51] Int. Cl.[2] ..... C22C 21/02

[58] Field of Search ..... 75/148, 138, 141, 142, 75/143, 146, 147; 29/193, 183, 183.5, 527.7; 148/2, 3, 11.5 A, 32; 164/76

[56] References Cited

UNITED STATES PATENTS 1,579,481 4/1926 Hybinette ..... 75/138

3,811,846 5/1974 Schoerner et al..... 75/138

*Primary Examiner*—R. Dean

*Attorney, Agent, or Firm*—Van C. Wilks; Herbert M. Hanegan; Stanley L. Tate

[57] ABSTRACT

Disclosed in the appended specification and claims are a high tensile strength aluminum alloy having high elongation and a minimum conductivity of about 60.0 percent IACS consisting of from about 0.08 to about 0.90 weight percent silicon, from about 0.30 to about 1.30 weight percent iron, from about 0.20 to about 1.60 weight percent cobalt and from about 96.20 to about 99.02 weight percent aluminum and a method of producing the alloy comprising the steps of alloying the recited elements, continuously casting the alloy into a bar, hot-rolling the bar substantially as cast into a continuous rod, cold drawing the continuous rod into a wire without intermediate anneals and annealing or partially annealing the wire.

9 Claims, No Drawings

ALUMINUM IRON COBALT SILICON ALLOY AND METHOD OF PREPARATION THEREOF

BACKGROUND OF THE DISCLOSURE

This invention relates to an aluminum alloy suitable for use in fabricating an electrical conductor and more particularly concerns an aluminum alloy suitable for fabricating an electrical conductor for use in applications in which the electrical conductor is required to have high tensile strength and to retain tensile strength for extended periods of time at high operating temperatures.

The use of various aluminum alloys to fabricate electrical conductors is well established in the art. Such alloys characteristically have conductivities of at least 61 percent of the International Annealed Copper Standard, hereinafter referred to as IACS and chemical constituents consisting of a substantial amount of pure aluminum and small amounts of impurities such as silicon, vanadium, iron, copper, manganese, magnesium, zinc, boron and titanium. The physical properties of electrical conductors fabricated from prior aluminum alloys have proven less than satisfactory for many applications which reqire that the electrical conductor used have a high tensile strength which is retained after extended periods at high operating temperatures. Generally desirable tensile strength and thermal stability have been obtainable only at less than desirable elongation.

For example, it is generally accepted that industrial purity aluminum has a recrystallization temperature of from about 300° to about 662°F (150° to 350°C). It is also accepted that such aluminum has a very low resistance to heat and undergoes a softening phenomenon at a temperature of from about 212° to about 392°F (100° to 200°C). Much work has been done in the past to improve the heat resistance of aluminum, however the majority of alloys developed which have acceptable electrical conductivity undergo a significant loss of strength upon being exposed to temperatures of from about 300° to about 392°F (150° to 200°C) for several hours. Such alloys usually retain only from about 60 to about 80 percent of their original tensile strength and elongation after exposure to temperatures in this range for several hours.

Thus, it becomes apparent that a need has arisen within the electrical industry for an aluminum alloy from which electrical conductors might be fabricated which will have improved thermal stability, tensile strength and elongation and acceptable conductivity, and yield strength.

In the past aluminum alloys and rod for the fabrication of wire have been manufactured for commercial use by a plurality of separate steps which include casting an aluminum alloy ingot, reheating the ingot to a temperature which would permit hot rolling of the cast ingot into redraw rod, solutionizing the rod and water quenching the rod before cold drawing the rod into wire. After drawing the wire fabricated by the aforementioned procedure is generaly annealed in order to obtain acceptable tensile strength. Although wire produced by the aforementioned techniques has acceptable tensile strength, it is difficult and in fact almost impossible to produce an aluminum alloy wire having high thermal stability and acceptable elongation and electrical conductivity using this technique because the procedure inherently produces a structure which contains elements in solution because all the alloying elements are not removed from solution by the quenching steps and because large precipitates are formed if the alloy is processed at high temperatures. The cell structure of aluminum alloy wire fabricated from base metal so processed is unstable thereby promoting the formation of large cells when the wire is subjected to any heat treatment thereby leading to a finished product which has either poor thermal stability or poor physical and poor electrical properties.

Therefore it becomes apparent that there remains a need within the electrical industry for an efficient and economical method of fabricating an aluminum alloy and an aluminum alloy rod from which an electrical conductor having high tensile strength which is retained during extended periods at high temperatures and acceptable electrical properties can be fabricated.

SUMMARY OF THE INVENTION

Thus, it is an object of this invention to provide an aluminum alloy suitable for use in the production of an electrical conductor for use in applications which require electrical conductors with a high tensile strength which is retained during extended periods at high operating temperatures.

Another object of the present invention is to provide a heat resistant aluminum alloy which has an increased tensile strength when compared to prior heat resistant aluminum alloys.

Another object of the present invention is to provide an aluminum alloy which when compared to prior aluminum alloys has a higher recrystallization temperature.

Yet another object of the present invention is to provide an aluminum alloy having high elongation.

Yet another object of the present invention is to provide an aluminum alloy having a high yield strength.

Still another object of the present invention is to provide an aluminum alloy which has a high tensile strength.

Still another object of the present invention is to provide an aluminum alloy having an electrical conductivity of at least 60 percent IACS.

Still another object of the present invention is to provide a method of manufacturing an aluminum alloy having high tensile strength, high ultimate elongation, acceptable yield tensile strength and electrical conductivity.

The above and other objects of the present invention are accomplished by an aluminum alloy containing from about 0.08 to about 0.90 weight percent silicon, from about 0.30 to about 1.30 weight percent iron, from about 0.20 to about 1.60 weight percent cobalt with the balance of the alloy consisting of aluminum containing trace elements selected from the group consisting of copper, manganese, magnesium, titanium, vanadium and zinc when the concentrations of the individual trace elements do not exceed 0.05 weight percent and the total trace elements concentration does not exceed 0.15 weight percent. Further, the above and other objects of the present invention are accomplished by a method comprising the steps of alloying from about 0.08 to about 0.90 weight percent silicon, from about 0.30 to about 1.30 weight percent iron, from about 0.20 to about 1.60 weight percent cobalt with from about 96.20 to about 99.42 weight percent aluminum when the aluminum contains trace elements selected from the group consisting of copper, manganese, magnesium, titanium, vanadium and zinc and the concentrations of the individual trace elements do not exceed 0.05 weight percent and the total trace element concentration does not exceed 0.15 weight percent. Casting the alloy in a moving mold formed between a groove in the periphery of a rotating casting wheel and a metal belt lying adjacent to the groove for a portion of its length and hot-rolling the cast alloy substantially immediately after casting while the cast alloy is in substantially that condition as cast to form a continuous rod, cold-drawing the rod into wire without intermediate anneals and subsequently annealing or partially annealing the wire.

Having in mind the above and other objects that will become apparent from a reading of this disclosure, the present invention comprises the combinations and arrangements of alloy ingredients and steps illustrated in the presently preferred embodiment of the invention which is hereinafter set forth in sufficient detail to enable those persons of ordinary skill in the art to clearly understand the function, operation, composition and advantages of it when read in conjunction with the accompanying examples.

DESCRIPTION OF THE PREFERRED EMBODIMENT

For the purpose of clarity, the following terminology used in this application is explained as follows:

Rod — A solid product that is long in relation to its cross section. Rod normally has a cross section of between 3 inches and 0.375 inches.

Wire — A solid wrought product that is long in relation to its cross section, which is square or rectangular with sharp or rounded corners or edges or is round, a regular hexagon, or a regular octagon, and whose diameter or greatest perpendicular distance between parallel faces is between 0.374 inches and 0.0031 inches.

The present aluminum alloy is prepared by initially melting an alloying aluminum with the necessary amounts of silicon and other constituents to provide the requisite alloy for processing. Normally the content of iron in the alloy is maintained at levels ranging downward from 0.30 weight percent. Typical impurities or trace elements are also present within the melt, but only in trace quantities such as less than 0.05 weight percent each with a total content of trace impurities generally not exceeding 0.15 weight percent. Of course, when adjusting the amounts of trace elements due consideration must be given to the conductivity of the final alloy since some trace elements affect conductivity more severely than others. The typical trace elements include vanadium, manganese, magnesium, zinc, boron and titanium. If the content of the titanium is relatively high (but still quite low compared to the aluminum, iron and silicon content), small amounts of boron may be added to tie up the excess titanium and keep it from reducing the conductivity of the wire.

Silicon, iron and cobalt are the major constituents added to the melt to produce the alloy of the present invention. Normally, about 0.48 weight percent silicon, about 0.47 weight percent iron and about 0.50 weight percent cobalt are added to the typical aluminum component used to prepare the present alloy. Of course, the scope of the present invention includes the addition of more or less silicon and iron together with the adjustment of the content of all alloying constituents.

After alloying, the melted aluminum composition is continuously cast into a continuous bar. The bar is then hot-worked in substantially that condition in which it is received from the casting machine. A typical hot-working operation comprises rolling the cast bar in a rolling mill substantially immediately after being cast into a bar.

One example of a continuous casting and rolling operation capable of producing continuous rod as specified in this application is as follows:

A continuous casting machine serves as a means for solidifying the molten aluminum alloy metal to provide a cast bar that is conveyed in substantially the condition in which it is solidified from the continuous casting machine to the rolling mill, which serves as a means for hot-forming the cast bar into a rod or another hot-formed product in a manner which imparts substantial movement to the cast bar along a plurality of angularly disposed axes.

The continuous casting machine is of conventional casting wheel type having a casting wheel with a casting groove partially closed by an endless belt supported by the casting wheel and at least one idler pulley. The casting wheel and the endless belt cooperate to provide a mold into one end of which molten metal is poured to solidify and from the other end of which the cast bar is emitted in substantially that condition in which it is solidified.

The rolling mill is of conventional type having a plurality of roll stands arranged to hot-form the cast bar by a series of deformations. The continuous casting machine and the rolling mill are positioned relative to each other so that the cast bar enters the rolling mill substantially immediately after solidification in substantially that condition in which it was solidified. In this condition the cast bar is at a hot-forming temperature within the range of temperatures for hot-forming the cast bar at the initiation of hot-forming without heating between the casting machine and the rolling mill. In the event that it is desired to more closely control the hot-forming temperature of the cast bar within the conventional range of hot-forming temperatures, means for adjusting the temperature of the cast bar may be placed between the continuous casting machine and the rolling mill without departing from the inventive concept disclosed herein.

The roll stands each include a plurality of rolls which engage the cast bar. The rolls of each roll stand may be two or more in number and arranged diametrically opposite from one another or arranged at equally spaced positions about the axis of movement of the cast bar through the rolling mill. The rolls of each roll stand of the rolling mill are rotated at a predetermined speed by a power means such as one or more electric motors and the casting wheel is rotated at a speed generally determined by its operating characteristics. The rolling mill serves to hot-form the cast bar into a rod of a cross-sectional area substantially less than that of the cast bar as it enters the rolling mill.

The peripheral surfaces of the rolls of adjacent roll stands of the roll stand change in configuration; that is, the cast bar is engaged by the rolls of successive roll stands with surfaces of varying configuration, and from different directions. This varying surface engagement of the cast bar and the roll stand functions to knead or shape the metal in the cast bar in such a manner that it is worked at each roll stand and also to simultaneously reduce and change the cross-sectional area of the cast bar into that of the rod.

As each roll stand engages a cast bar, it is desirable that the cast bar be received with sufficient volume per unit of time at the roll stand for the cast bar to generally fill the space defined by the rolls of the roll stand so that the rolls will be effective to work the metal in the cast bar. However, it is also desirable that the space defined by the rolls of each roll stand not be overfilled so that the cast bar will not be forced into the gaps between the rolls. Thus, it is desirable that the rod be fed toward each roll stand at a volume per unit of time which is sufficient to fill, but not overfill, the space defined by the rolls of the roll stand.

As the cast bar is received from the continuous casting machine, it usually has one large, flat surface corresponding to the surface of the endless band and inwardly tapered side surfaces corresponding to the shape of the groove in the casting wheel. As the cast bar is compressed by the rolls of the roll stand, the cast bar is deformed so that it generally takes the cross-sectional shape defined by the adjacent peripheries of the rolls of each roll stand.

Thus, it will be understood that with this apparatus cast aluminum rod of an infinite number of different lengths is prepared by simultaneous casting of the molten aluminum alloy and hot-forming or rolling the cast aluminum bar.

The continuous rod produced by the casting and rolling operation is then processed in a reduction operation designed to produce continuous wire of various gauges. The unannealed rod (i.e., as rolled to F temper) is drawn through a series of progressively constricted dies, without intermediate anneals, to form a continuous wire of desired diameter. At the conclusion of this drawing operation, the alloy wire will have an excessively high tensile strength, yield strength and unacceptably low ultimate elongation, plus a conductivity below that which is industry accepted as a minimum for the electrical conductor, i.e., 61 percent of IACS. The wire is then annealed or partially annealed to obtain the desired tensile strength, ultimate elongation and conductivity and is subsequently cooled. At the conclusion of the annealing operation, it is found that the annealed alloy wire has the properties of acceptable conductivity and improved tensile strength together with unexpectedly improved percent ultimate elongation and a surprisingly increased thermal stability as specified previously in his application. The annealing operation may be continuous as in resistance annealing, induction annealing, convection annealing by continuous furnaces or radiation annealing by continuous furnaces, or preferably, may be batch annealing in a batch furnace. Continuous annealing temperatures of from about 900° to about 1200°F may be employed with annealing times of from about 0.001 seconds to about one (1.0) second. Batch annealing temperatures of from about 350° to about 800°F may be employed with annealing times of from about 8 hours to about 0.5 hours. Generally, however, annealing times and temperatures may be adjusted to meet the requirements of the particular overall processing operation so long as the desired tensile strength, elongation, conductivity and thermal stability is achieved. By way of example, it is found that the following physical properties and electrical conductivities in the present aluminum alloy wire are achieved with the listed batch annealing temperatures and times.

TABLE I

| | | 0.102"DIAMETER WIRE | | | | | | | | | | | |
|---|---|---|---|---|---|---|---|---|---|---|---|---|---|
| | | As-Rolled Rod | | | | As-Drawn | | | | 2 Hours 450°F | | | |
| Bar No. | % Si | UTS × $10^3$ | YTS × $10^3$ | Elong. | % IACS | UTS × $10^3$ | YTS × $10^3$ | Elong. | % IACS | UTS × $10^3$ | YTS × $10^3$ | Elong. | % IACS |
| 30 | .04 | 24.7 | 20.6 | 4.3 | 60.1 | 31.0 | 25.3 | 2.8 | 59.7 | 20.4 | 19.0 | 2.4 | 61.1 |
| 31 | .14 | 25.9 | 21.3 | 4.9 | 59.6 | 34.0 | 27.0 | 2.7 | 59.4 | 19.1 | 18.2 | 12.4 | 61.2 |
| 32 | .18 | 26.6 | 22.6 | 4.1 | 59.4 | 36.6 | 29.5 | 2.5 | 59.0 | 19.7 | 18.5 | 8.3 | 61.1 |
| 33 | .27 | 27.2 | 23.0 | 4.8 | 58.4 | 37.1 | 29.2 | 3.4 | 58.2 | 20.9 | 19.3 | 3.5 | 60.8 |
| 34 | .38 | 26.9 | 24.0 | 4.2 | 57.7 | 38.0 | 28.9 | 2.8 | 57.5 | 21.3 | 19.6 | 3.1 | 60.7 |
| 35 | .47 | 27.3 | 23.7 | 4.8 | 56.8 | 37.3 | 30.6 | 3.3 | 56.7 | 22.3 | 20.0 | 3.9 | 60.6 |
| 36 | .48 | 27.3 | 24.0 | 5.1 | 56.5 | 37.8 | 29.4 | 3.6 | 56.7 | 22.8 | 19.6 | 2.1 | 60.4 |
| 37 | .64 | 28.3 | 23.0 | 4.6 | 55.0 | 38.8 | 31.9 | 4.2 | 55.4 | 23.8 | 21.0 | 5.8 | 60.3 |
| 38 | .88 | 30.0 | 36.2 | 5.5 | 52.6 | 39.1 | 34.0 | 3.6 | 52.3 | 25.8 | 22.6 | 8.2 | 59.6 |

TABLE II

| | | 0.102" DIAMETER WIRE | | | | | | | | | | | |
|---|---|---|---|---|---|---|---|---|---|---|---|---|---|
| | | 2 Hours 500°F | | | | 2 Hours 550°F | | | | 2 Hours 600°F | | | |
| Bar No. | % Si | UTS × $10^3$ | YTS × $10^3$ | Elong. | % IACS | UTS × $10^3$ | YTS × $10^3$ | Elong. | % IACS | UTS × $10^3$ | YTS × $10^3$ | Elong. | % IACS |
| 30 | .04 | 17.5 | 16.3 | 17.4 | 61.3 | 16.4 | 14.1 | 18.0 | 61.4 | 15.8 | 12.3 | 25.9 | 61.4 |
| 31 | .14 | 16.5 | 14.0 | 20.5 | 61.4 | 15.6 | 11.7 | 24.4 | 61.4 | 15.0 | 10.3 | 26.6 | 61.5 |
| 32 | .18 | 16.3 | 12.8 | 23.7 | 61.4 | 15.2 | 10.1 | 26.0 | 61.4 | 15.1 | 9.1 | 28.9 | 61.3 |
| 33 | .27 | 16.9 | 13.4 | 19.7 | 61.0 | 15.1 | 7.9 | 29.6 | 61.1 | 15.5 | 7.2 | 29.7 | 60.8 |
| 34 | .38 | 17.9 | 14.7 | 17.9 | 61.0 | 15.4 | 8.2 | 29.6 | 61.0 | 15.4 | 7.2 | 28.7 | 60.6 |
| 35 | .47 | 19.0 | 16.0 | 16.4 | 60.9 | 16.0 | 8.3 | 20.3 | 60.9 | 15.8 | 6.9 | 28.4 | 60.5 |
| 36 | .48 | 18.4 | 15.5 | 14.5 | 60.4 | 15.6 | 8.0 | 29.5 | 60.3 | 15.5 | 7.0 | 26.7 | 60.4 |
| 37 | .64 | 20.1 | 16.9 | 15.4 | 60.3 | 16.2 | 8.7 | 19.9 | 60.6 | 16.3 | 7.2 | 28.5 | 60.3 |
| 38 | .88 | 22.0 | 17.8 | 11.8 | 59.8 | 17.4 | 9.6 | 12.5 | 60.0 | 17.1 | 8.7 | 25.5 | 59.8 |

During the continuous casting of this alloy, a substantial portion of the silicon, iron and cobalt present in the alloy precipitate out of solution as aluminum-iron-silicon-cobalt intermetallic compounds. Included for illustration but not limitation among the aluminum, iron, silicon, cobalt intermetallic compounds which precipitate out of solution during casting are $Co_2Al_9$, $FeAl_3$, $FeAl_6$, $Al_9Fe_2Si_2$, $Al_{12}Fe_3Si$ and other intermetallic compounds having the general formula $Al_xFe_ySi_z$. Thus, after casting the bar contains a dispersion of fine particles of the above mentioned intermetallic compound in a supersaturated solid solution matrix. As the bar is rolled in a hot-working operation immediately after casting, the intermetallic particles are broken up and dispered throughout the matrix thereby inhibiting large cell formation. When the rod is drawn to its final size without intermediate anneals and then aged in a final annealing operation, the tensile strength, elongation and thermal stability are increased due to the small cell size and the additional pinning of dislocations by the preferential precipitation of the aluminum-iron-silicon-cobalt intermetallic compound on the dislocations sites. Therefore, these dislocation sources must be activated under the applied stress of the drawing operation and this causes both the tensile strength, yield strength, elongation and thermal stability to be further improved. The properties of the present aluminum alloy wire are significantly affected by the size of the aluminum-iron-silicon-cobalt particles in the matrix. Coarse precipitates reduce the percent elongation and thermal stability of the wire by enhancing neucleation and thus, formation of large cells which, in turn lowers the recrystalization temperature of the wire. Fine precipitates improve the percent elongation, tensile strength, conductivity, and thermal stability of the wire by reducing nucleation and increasing the recrystalization temperature. Grossly coarse precipitates of the iron-aluminum-silicon-cobalt intermetallic compound cause the wire to become brittle and generally unuseful. Coarse precipitates have a particle size of above one micron, measured along the transverse axis of the particle, and fine precipitates have a particle size of below one micron, measured along the transverse axis of the particle.

A more complete understanding of the invention will be obtained from the following examples.

EXAMPLE 1–10

A comparison of prior aluminum alloy wire and the present aluminum alloy wire was made by preparing a prior aluminum alloy containing 0.47 percent iron, 0.04 percent silicon, 0.001 percent copper, 0.003 percent manganese, 0.001 percent magnesium, 0.001 percent vanadium, 0.015 percent zinc and 0.50 percent cobalt with the balance being aluminum. Samples of the present alloy were prepared from aluminum which contained impurity levels equal to the impurity levels set out in the prior aluminum alloy sample, however the silicon content of each sample of the present invention was varied in a range from 0.08 to 0.88 percent silicon; the iron concentration of the alloys was held constant at 0.47 weight percent and the cobalt concentration was held constant at 0.50 weight percent. All samples were continuously cast into continuous bars and hot-rolled in continuous rod in similar fashion. The alloys were then cold drawn through successively constricting dyes to yield a wire having a diameter of 0.102 inches. Sections of the wire were collected on separate bobbins and batch furnace annealed at various temperatures and for various lengths of time to yield sections of prior aluminum alloy and the present alloy of varying tensile strengths. Several samples of each section were tested in a devce designed to measure the ultimate tensile strength of each section, the elongation of each section and the yield tensile strength of each section. Selected samples were then annealed in a batch furnace at 500°F for a period of 2 hours and allowed to cool. After the cooling period, the samples were tested to determine ultimate tensile strength and yield tensile strength and similar samples were then aged for 4 hours at 482°F to determine the thermal stability of samples having different silicon concentrations. The results are as follows:

TABLE 3

| Bar No. | % Si | 4 Hours at 482°F UTS × $10^3$ | % Ret. | YTS × $10^3$ | % Ret. |
|---|---|---|---|---|---|
| 30 | .04 | 17.5 | 96 | 16.3 | 96 |
| 31 | .14 | 16.5 | 98 | 14.0 | 96 |
| 32 | .18 | 16.3 | 96 | 12.8 | 91 |
| 33 | .27 | 16.9 | 94 | 13.4 | 87 |
| 34 | .38 | 17.9 | 92 | 14.7 | 85 |
| 35 | .47 | 19.0 | 92 | 16.0 | 86 |
| 36 | .48 | 18.5 | 94 | 15.5 | 91 |
| 37 | .64 | 20.1 | 93 | 16.9 | 92 |
| 38 | .88 | 22.0 | 94 | 17.8 | 92 |

Generally the aluminum alloy of the present invention consists of from about 0.08 to about 0.90 weight percent silicon, from about 0.30 to about 1.60 weight percent iron and from about and from about 0.20 to about 1.60 weight percent cobalt with the balance of the alloy consisting of aluminum containing trace elements selected from the group consisting of copper, manganese, magnesium, titanium, vanadium and zinc when the individual concentrations of the trace elements does not exceed 0.05 weight percent and the total trace elements concentration does not exceed 0.15 weight percent. Good tensile strength, yeild strength, ultimate elongation, electrical properties and thermal stability have been obtained with an alloy which consists of from about 0.08 to about 0.20 weight percent silicon, from about 0.30 to about 1.30 weight percent iron, from about 0.20 to about 1.60 weight percent cobalt with the balance of the alloy consisting of aluminum containing trace elements selected from the group consisting of copper, manganese, magnesium, titanium, vanadium and zinc when the concentrations of the individual trace elements do not exceed 0.05 weight percent and the total trace element concentration does not exceed 0.15 weight percent. Good tensile strength, retention of tensile strength after exposure to elevated temperatures for extended periods of time and an electrical conductivity of at least 60 percent IACS are obtained with an alloy containing from about 0.20 to about 0.47 weight percent silicon, an iron concentration of from about 0.30 to about 1.30 weight percent, a coablt concentration of from about 0.20 to about 1.60 weight percent and aluminum containing the previously specified trace elements. Superior results are obtained when the silicon concentration of the present alloy consists of from about 0.48 to about 0.88 weight percent, an iron concentration of from about 0.30 to about 1.30 weight percent, a cobalt concentration of from about 0.20 to about 1.20 weight percent and the aluminum which makes up the balance of the alloy contains trace elements of the type and amounts previously recited.

While this invention has been described in detail with particular references to preferred embodiments thereof, it will be understood that variations and modifications can be effective within the spirit and scope of the invention as described hereinbefore and as defined in the appended claims.

What is claimed is:

1. A heat resistant aluminum alloy consisting essentially of from about 0.48 to about 0.88 weight percent silicon, from about 0.30 to about 1.30 weight percent iron, from about 0.20 to about 1.60 weight percent cobalt and the balance of aluminum containing trace elements selected from the group consisting of copper, manganese, magnesium, titanium, vanadium and zinc wherein individual concentrations of said trace elements do not exceed 0.05 weight percent and the total concentration of said trace elements does not exceed 0.15 weight percent.

2. The heat resistant aluminum alloy of claim 1 wherein the concentration of silicon is from about 0.88 to about 0.48 weight percent, the concentration of iron is from about 0.30 to about 0.95 weight percent and the concentration of cobalt is from about 0.20 to about 0.50 weight percent.

3. The heat resistant aluminum alloy of claim 1 wherein the concentration of silicon is from about 0.48 to about 0.88 weight percent, the concentration of iron is from about 0.30 to about 0.55 weight percent and the concentration of cobalt is from about 0.50 to about 0.80 weight percent.

4. The heat resistant aluminum alloy of claim 1 wherein the silicon concentration is from about 0.48 to about 0.88 weight percent, the iron concentration is from about 0.55 to about 1.30 weight percent and the cobalt concentration is from about 0.80 to about 1.60 weight percent.

5. The heat resistant aluminum alloy of claim 3 wherein the concentration of silicon is from about 0.48 to about 0.98 weight percent.

6. A heat resistant aluminum alloy electrical conductor having evenly dispersed therein iron-aluminum-silicon-cobalt intermetallic particles having a particle diameter of less than 1 micron when measured along the transverse axis of said particles and the minimum electrical conductivity of 61 percent IACS consisting essentially of from about 0.48 to about 0.88 weight percent silicon, from about 0.30 to about 1.30 weight percent iron, from about 0.20 to about 1.60 weight percent cobalt and from about 96.20 to about 99.02 weight percent aluminum; said aluminum containing trace elements selected from a group consisting of copper, manganese, magnesium, titanium, vanadium, and zinc wherein the individual concentrations of said trace elements do not exceed about 0.05 weight percent and the total concentration of said trace elements does not exceed about 0.15 weight percent.

7. A method of preparing a heat resistant aluminum alloy electrical conductor having a minimum electrical conductivity of 61 percent IACS and having evenly dispersed therein iron-aluminum-silicon-cobalt intermetallic particles having a particle diameter of less than 1 one micron when measured along the transvere axis of said particles comprising the steps of:

a. alloying from about 0.48 to about 0.88 weight percent silicon, from about 0.30 to about 1.30 weight percent iron, from about 0.20 to about 1.60 weight percent cobalt, and from about 96.20 to about 99.02 weight percent aluminum;

b. casting the alloy in a moving mold formed between a groove in the periphery of a rotating casting wheel and a metal belt adjacent to said groove for a portion of its length to form a continuous bar; and c. hot-rolling the continuous bar substantially immediately after casting while the continuous bar is in substantially that condition as cast to form a continuous rod.

8. The method of claim 7 further including the steps of drawing said continuous rod through a series of wire-drawing dies without intermediate anneals to form a wire; and annealing or partially annealing said wire.

9. The method of claim 8 wherein the step of annealing or partially annealing said wire comprises batch annealing said wire for a time of from about 30 minutes to about 8 hours at a temperature of from about 350° to about 800°F.

* * * * *